US010638818B2

(12) United States Patent
Hung et al.

(10) Patent No.: US 10,638,818 B2
(45) Date of Patent: May 5, 2020

(54) SLIDER WITH REBOUNDABLE PULL-TAB

(71) Applicant: IDEAL FASTENER (GUANG DONG) INDUSTRIES LTD., Zhaoqing, Guangdong (CN)

(72) Inventors: Franklin Chi Yen Hung, Guangdong (CN); William Qiu, Guangdong (CN); Ali Lv, Guangdong (CN); Fukang Wu, Guangdong (CN); Andy Zeng, Guangdong (CN)

(73) Assignee: IDEAL FASTENER (GUANG DONG) INDUSTRIES LTD., Zhaoqing, Guangdong ( * ) Notice: Subject to any disclaimer, the term of this patent is extended or adjusted under 35 U.S.C. 154(b) by 0 days.

(21) Appl. No.: 15/539,132

(22) PCT Filed: Jun. 4, 2016

(86) PCT No.: PCT/CN2016/084876
§ 371 (c)(1),
(2) Date: Jun. 22, 2017

(87) PCT Pub. No.: WO2017/197668
PCT Pub. Date: Nov. 23, 2017

(65) Prior Publication Data

US 2019/0059525 A1 Feb. 28, 2019

(30) Foreign Application Priority Data

May 16, 2016 (CN) ..... 2016 1 0325696

(51) Int. Cl.
*A44B 19/30* (2006.01)
*A44B 19/26* (2006.01)

(52) U.S. Cl.
CPC ..... *A44B 19/308* (2013.01); *A44B 19/26* (2013.01); *A44B 19/262* (2013.01)

(58) Field of Classification Search
CPC ..... A44B 19/308; A44B 19/262; A44B 19/26
See application file for complete search history.

(56) References Cited

U.S. PATENT DOCUMENTS 2,263,393 A * 11/1941 Marinsky ..... A44B 19/262 24/419
2,289,585 A * 7/1942 Marinsky ..... A44B 19/308 24/424
2,290,834 A * 7/1942 Kohler ..... A44B 19/305 24/419
2,303,751 A * 12/1942 Marinsky ..... A44B 19/308 24/424

(Continued)

*Primary Examiner* — Robert Sandy
*Assistant Examiner* — Louis A Mercado

(57) ABSTRACT

A slider with a reboundable pull-tab includes a slider base, a pull-tab, a connecting shaft and spring; the slider base has a connecting shaft through-hole for mounting the connecting shaft, which fixes the pull-tab and spring onto the slider base; one end of the spring inserts into the slider, and the other end inserts into the spring base; when the pull-tab is pulled, the spring will subject to torsional deformation; when the pull-tab is let go, the pull-tab will revert to the normal state under the impetus of the spring, then the slider is automatically locked, thus preventing unexpectedly sliding; there is also a locking part in the pull-tab, so that it is free from not being able to rebound due to over-rotation.

7 Claims, 13 Drawing Sheets

(56) References Cited

U.S. PATENT DOCUMENTS

| | | | | | |
|---|---|---|---|---|---|
| 2,397,693 | A * | 4/1946 | Rabinow | A44B 19/308 | 24/420 |
| 2,535,505 | A * | 12/1950 | Morin | A44B 19/262 | 24/419 |
| 2,784,474 | A * | 3/1957 | Morin | A44B 19/308 | 24/424 |
| 5,152,036 | A * | 10/1992 | Oda | A44B 19/308 | 24/421 |
| 6,499,200 | B1 * | 12/2002 | Yamagishi | A44B 19/308 | 24/415 |
| 6,944,919 | B2 * | 9/2005 | Wang | A44B 19/262 | 24/429 |
| 9,936,774 | B2 * | 4/2018 | Hsu | A44B 19/26 | |
| 10,178,899 | B2 * | 1/2019 | Hsu | A44B 19/26 | |
| 2018/0132572 | A1 * | 5/2018 | Hung | A44B 19/262 | |

* cited by examiner

SLIDER WITH REBOUNDABLE PULL-TAB

FIELD OF THE INVENTION

The present invention relates to the field of zipper, and more particularly to a slider with a reboundable pull-tab.

BACKGROUND OF THE INVENTION

Among the slider for slide fastener with an automatic stopper, locking member such as claw structure is a normal technical means to achieve the function of automatic rebound. Chinese application 103220932A discloses a slider for a slide fastener with an automatic stopper. Said slider for a slide fastener with an automatic stopper, the slider comprising: a body forming an element guide passage into which fastener elements are insertable; a locking member swingably supported in the body by a pin, and having a locking claw which is protrudable from a locking window hole formed in the body to the element guide passage; and an urging member configured to urge the locking member so that the locking claw protrudes from the locking window hole to the element guide passage, wherein a pair of lateral plate portions disposed at both end portions of the pin are respectively provided with crimping protrusions which are abuttable against end faces of the pin and which are arranged at peripheral portions of a through-hole of the pair of lateral plate portions, through which the pin penetrates. The technical solution disclosed by the Chinese patent has a very complicated structure and lots of components. While the slider disclosed by the present invention has a very simple structure and could automatically rebound even if the pull-tab is pulled more than 90 degrees, and is free from unrebounding due to over-rotation.

SUMMARY OF THE INVENTION

The present invention provides a slider with a reboundable pull-tab, the pull-tab automatically springs back to the original point when pulled up and released, even when it is over-rotated.

The present invention also provides a slider comprising a slider base, a pull-tab, a connecting shaft and a spring; the slider base comprises an upper blade, a lower blade, and a connecting pin connecting the upper blade and the lower blade; upper bladelateral sides are formed on two sides of the upper blade, which has two through-holes for mounting the connecting shaft, namely first through-hole and second through-hole; the upper blade also has a square-shaped notch for disposing the pull-tab; the square-shaped notch further comprises an arc-shaped notch, whose anterior-end connects to the sidewalls of the square-shaped notch and whose posterior-end connects to the bottom surface of the square-shaped notch; a locking through-hole is disposed at the joint portion between the square-shaped notch and the arc-shaped notch; the locking through-hole separates the arc-shaped notch into a first arc-shaped notch on the side of the first through-hole and a second arc-shaped notch on the side of the second through-hole; an anterior-end platform is disposed at a joint portion of the anterior-end of the first arc-shaped notch and the sidewalls of the square-shaped notch, and the posterior-end of the first arc-shaped notch connects to the bottom surface by a locking vertical plane; the posterior-end of the second arc-shaped notch connects to the bottom surface directly and the anterior-end connects to the sidewalls of square-shaped notch; the anterior-end platform has a lug boss at the second arc-shaped notch.

The pull-tab comprises a pull-tab body, whose top-end has a spring mounting part and a locking part, wherein the spring mounting part and the locking part are adjacent to each other; the spring mounting part has a cambered surface and the locking part has a locking cambered surface that is lower than the spring mounting part; the top-end of the pull-tab body also has a connecting shaft through-hole for assembling the connecting shaft so as to fix the pull-tab to the slider base; the spring mounting part has a spring mounting hole coaxially provided with the connecting shaft through-hole, and the radius of the spring mounting hole is larger than the radius of the connecting shaft through-hole; the lateral side of the pull-tab body has a spring fixing hole communicating with the spring mounting hole.

Two ends of the spring has a first extending end and a second extending end, wherein the first extending end has a corner; when the slider is assembled, the spring is fit in the spring mounting hole; wherein the corner is disposed at the joint portion between the lug boss and the second arc-shaped notch; the second extending end inserts into the spring fixing hole; when the slider is assembled, the spring is in a compressed state.

Preferably, an annular platform protruding towards the side of the second through-hole is disposed at the place where the medial side surface of the upper blade surrounds the first through-hole to prevent the pull-tab from deflecting to the first through-hole, thus avoiding the friction between the pull-tab body and the side surface of the slider base when rotating the pull-tab, which would cause impeded rotation.

Preferably, two ends of the connecting shaft has fixed ends, and the through-holes have arc openings to contain the fixed ends so that the fixed ends could further prevent the slider from loosening when the slider is assembled.

Preferably, the bottom surface of the joint portion between the locking part and the spring mounting part has a protruding locking head, which inserts into the locking through-hole to prevent the pull-tab from sliding when the pull-tab is laid flat.

Preferably, the connecting shaft is set as a cylinder, one end of which has gear-shaped fixed end, whose addendum circle diameter is larger than that of the first through-hole and the second through-hole; when the slider is assembled, the fixed end would be damaged and inserted into the connecting shaft through-hole, ensuring the fixing effect.

Preferably, the connecting shaft is set as a cylinder, whose top-end has a fixed end and the bottom is set as a hollow tubular shape, when the slider is assembled, the bottom is stamped and the hollow tubular shape is turned outward to form a lug structure, the external diameter of the lug structure is larger than the diameter of the connecting shaft through-hole, thus ensuring the assembling effect.

Preferably, the spring mounting hole has a sectorial sunken structure disposed at the direction opposite to the locking head, and the sectorial sunken structure is formed at the outer side of the spring mounting hole. The angle of the sectorial sunken structure is larger than 90°. When rotating the pull-tab, the sectorial sunken structure enables the pull-tab to keep away from the extending ends of the spring, ensuring the normal deformation of the spring. And during installation, the spring could be engaged onto the joint portion between the sectorial sunken structure and the spring mounting hole, which facilitates assembly.

Preferably, the spring mounting hole is set as conical platform-shape, the radius of the end with its inner side connected to the connecting shaft through-hole is smaller than that of the end with its outer side connected to the pull-tab body. The bottom of the spring fixing hole has the same design that the radius of the inner side is smaller than that of the outer side, which makes the mould release more convenient during the preparation process.

Preferably, the second extending end of the spring has a fixed bending angle disposed within the spring fixing hole to prevent the spring from falling off.

Preferably, the spring fixing hole connects to the spring mounting hole, and the extension direction thereof is identical to that of the second extending end of the spring, ensuring the second extending end of the spring inserting into the fixing hole more conveniently to prevent the spring from falling off.

Preferably, the joint portion of the second extending end of the spring and the ring part of the spring has a corner, and the extension direction of the spring fixing hole in the pull-tab is identical to that of the second extending end of the spring, ensuring the second extending end of the spring inserting into the pull-tab and preventing the spring from falling off.

Preferably, the first extending end of the spring, the second extending end of the spring and the ring part of the spring are tangent to each other, and the extending ends have corner and fixed bending angle respectively, and the corner and fixed bending angle are of the same size so that the springs are compatibly used and both extending ends could be inserted into the pull-tab body and slider base.

BRIEF DESCRIPTION OF THE DRAWINGS

The present invention will become more readily apparent to those ordinarily skilled in the art after reviewing the following detailed description and accompanying drawings, in which.

DETAILED DESCRIPTION OF PREFERRED EMBODIMENTS

The present invention will now be described more specifically with reference to the following embodiments. It is to be noted that the following descriptions of preferred embodiments of this invention are presented herein for purpose of illustration and description only. It is not intended to be exhaustive or to be limited to the precise form disclosed.

Figure 1:
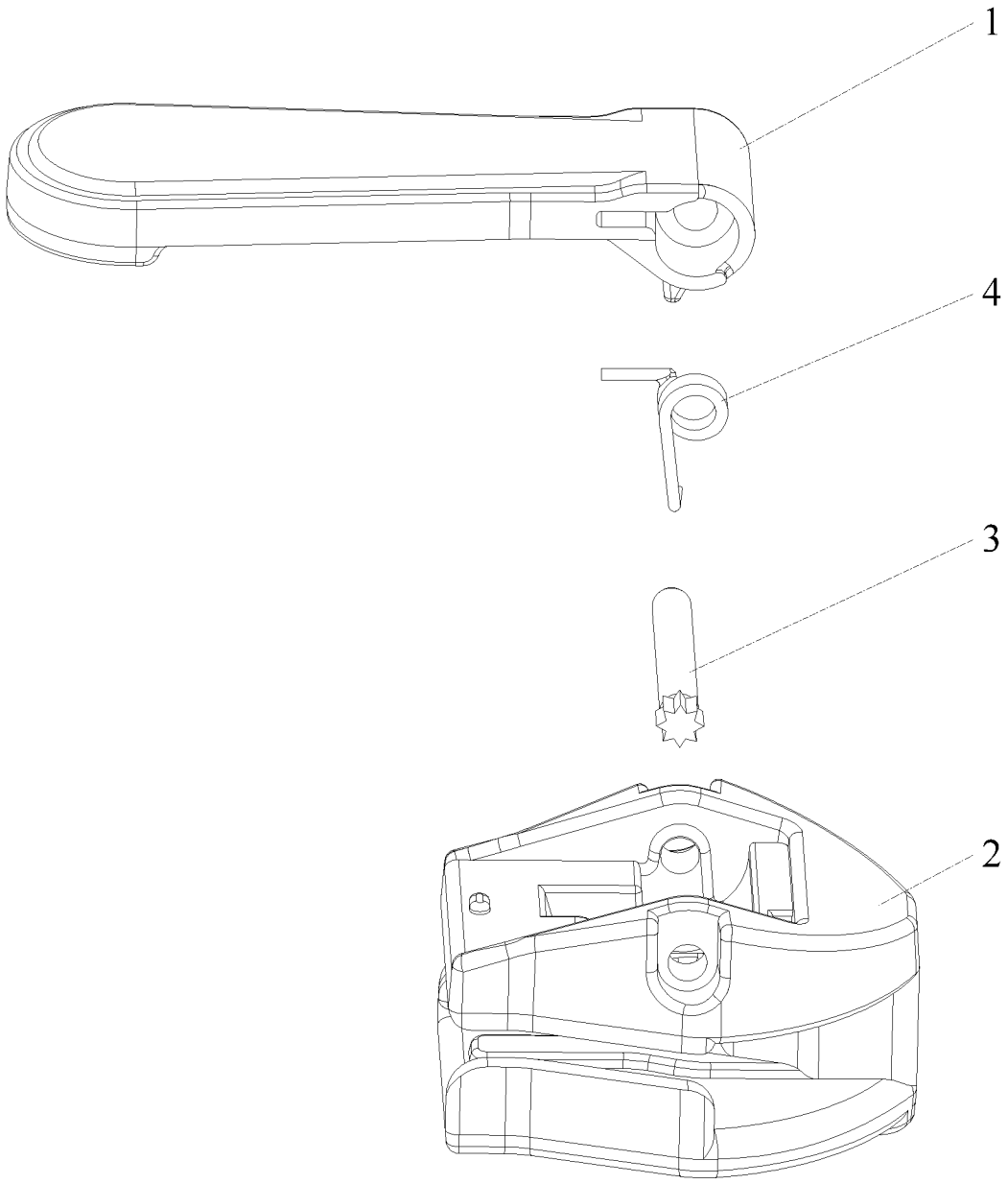
FIG. 1 is an exploded view of the slider.
Figure 2:
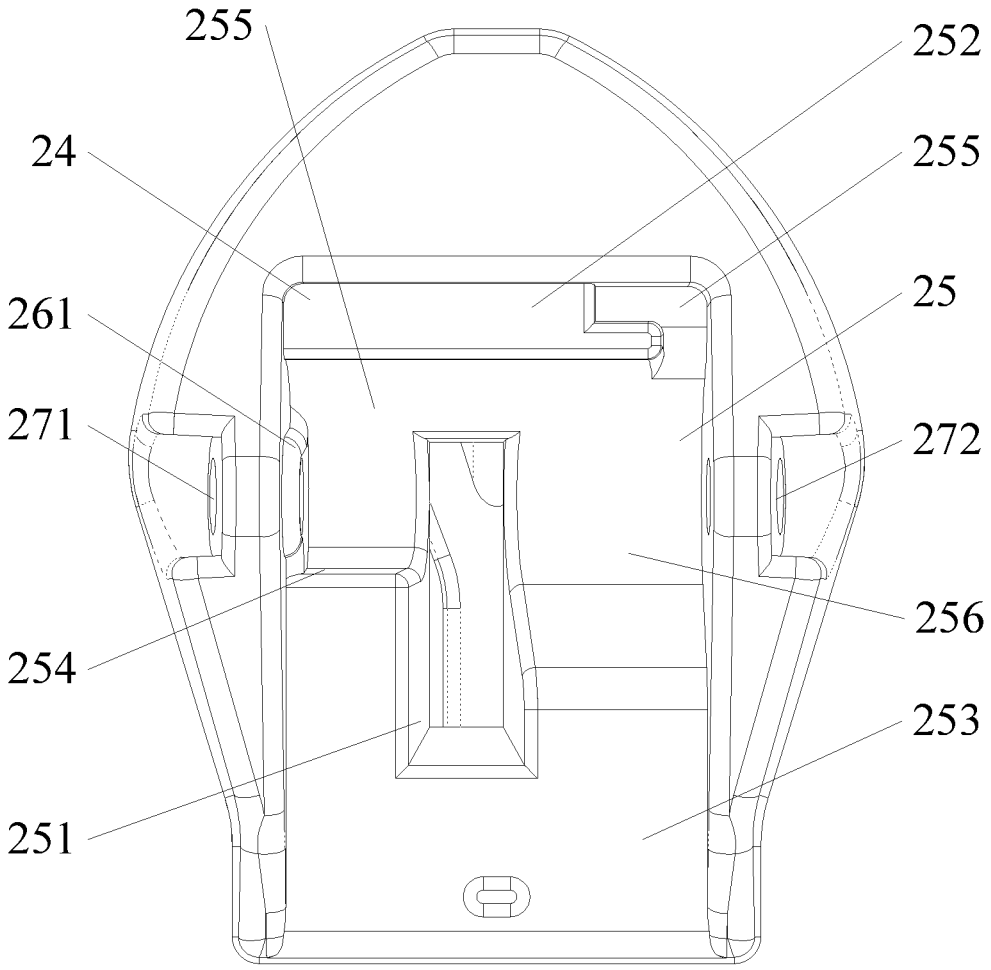
FIG. 2 is a schematic diagram of the slider base.
Figure 3:
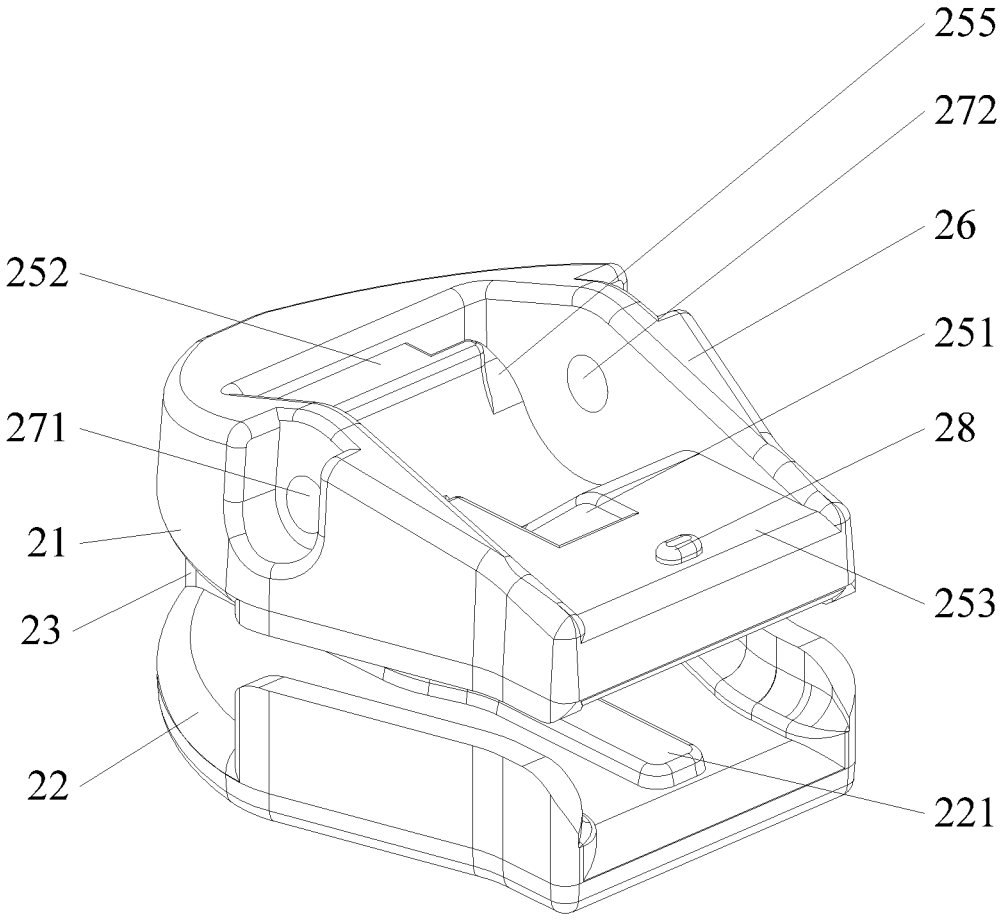
FIG. 3 is a perspective view of the slider base.

The present invention discloses a slider, as shown in FIG. 1, which comprises a slider base 2, a pull-tab 1, a connecting shaft 3 and a spring 4. As shown in FIG. 2 and FIG. 3, the slider base 2 comprises an upper blade 21, a lower blade 22, and a connecting pin 23 connecting the upper blade 21 and the lower blade 22; upper blade lateral sides 26 are formed on two sides of the upper blade 21, each of the upper blade lateral sides 26 has two through-holes, which comprise a first through-hole 271 and a second through-hole 272, for mounting the connecting shaft 3; the upper blade 21 also has a square-shaped notch 24 for disposing the pull-tab 1; the square-shaped notch 24 further comprises an arc-shaped notch 25, whose anterior-end connects to the side walls of the square-shaped notch 24 and whose posterior-end connects to the bottom surface 253 of the square-shaped notch 24; a locking through-hole 251 is disposed at the joint portion of the square-shaped notch 24 and arc-shaped notch 25; the locking through-hole 251 separates the arc-shaped notch 25 into a first arc-shaped notch 255 on the side of the first through-hole 271 and a second arc-shaped notch 256 on the side of the second through-hole 272; an anterior-end platform 252 is set at the joint portion of the anterior-end of the first arc-shaped notch 255 and the sidewalls of the square-shaped notch 24, and the posterior-end of the first arc-shaped notch 255 connects to the bottom surface 253 by a locking vertical plane 254; the posterior-end of the second arc-shaped notch 256 connects to the bottom surface 253 directly and the anterior-end connects to the sidewalls of the square-shaped notch 24; the anterior-end platform 252 has a lug boss 255 at the second arc-shaped notch 256.

Figure 4:
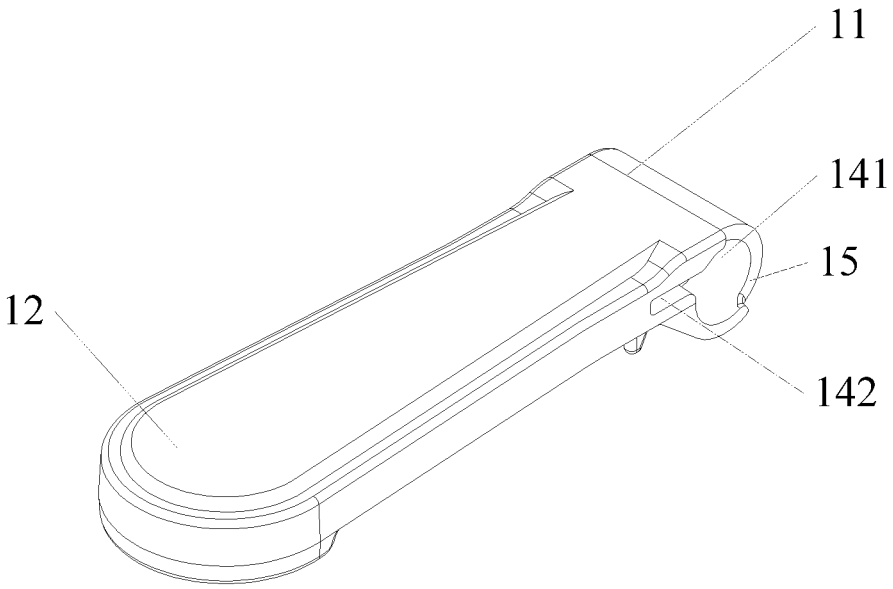
FIG. 4 is a perspective view of the pull-tab.
Figure 5:
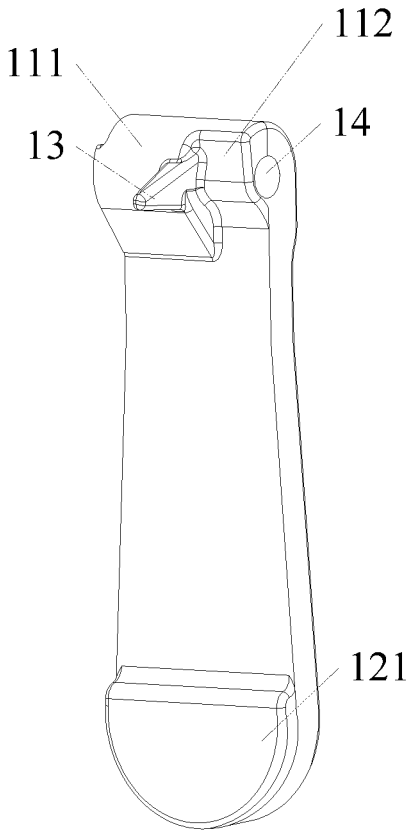
FIG. 5 is a perspective view of the pull-tab from another perspective.

As shown in FIG. 4 and FIG. 5, the pull-tab 1 comprises a pull-tab body 12, whose top-end 11 has a spring mounting part 111 and a locking part 112, wherein the spring mounting part 111 and the locking part 112 are adjacent to each other; the spring mounting part 111 has a cambered surface and the locking part 112 has a locking cambered surface that is lower than the spring mounting part 111; the top-end 11 of the pull-tab body 12 also has a connecting shaft through-hole 14 for assembling the connecting shaft 3 so as to fix the pull-tab 1 to the slider base 2; the spring mounting part 111 has a spring mounting hole 141 coaxially provided with the connecting shaft through-hole 14, and the spring mounting hole 141 has a larger radius than that of the connecting shaft through-hole 14; the lateral side of the pull-tab body 12 has a spring fixing hole 142 communicating with the spring mounting hole 141.

Figure 9:
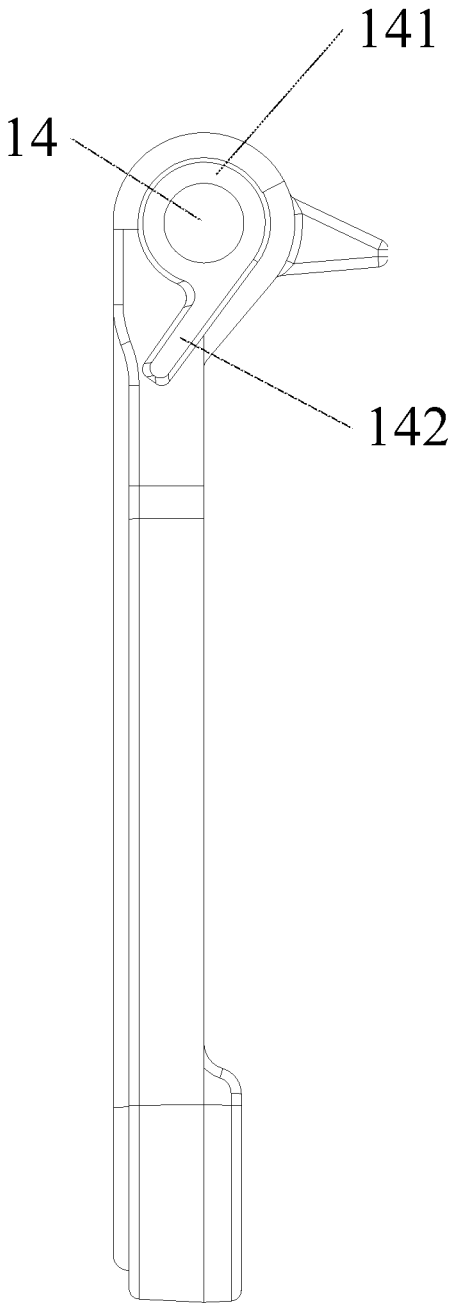
FIG. 9 is a perspective view of another pull-tab.
Figure 10:
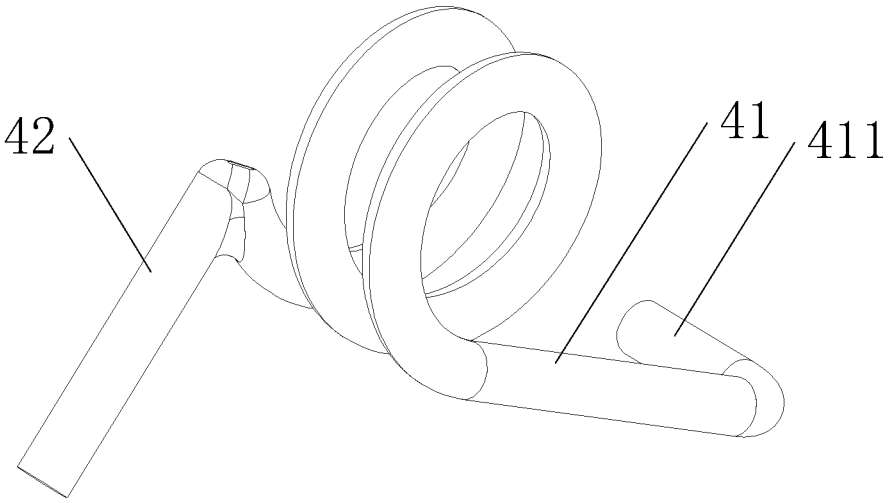
FIG. 10 is a schematic diagram of the spring.

As shown in FIG. 9 and FIG. 10, two ends of the spring 4 has a first extending end 41 and a second extending end 42, wherein the first extending end 41 has a corner 411; when the slider is assembled, the spring 4 would be fit in the spring mounting hole 141; wherein the corner 411 is disposed at the joint portion between the lug boss 255 and the second arc-shaped notch 256; the second extending end 42 inserts into the spring fixing hole 142; when the slider is assembled, the spring 4 would be in a compressed state.

In one embodiment of the present invention, an annular platform 261 protruding towards one side of the second through-hole 272 is disposed at the place where the medial side surface of the upper blade 21 surrounds the first through-hole 271 to prevent the pull-tab 1 from deflecting to the first through-hole 271, thus avoiding the friction between the pull-tab body 12 and the side surface of the slider base 2 when rotating the pull-tab 1, which would cause impeded rotation.

In one embodiment of the present invention, two ends of the connecting shaft 3 has fixed ends, and the through-holes have arc openings to contain the fixed ends so that the fixed ends could further prevent the slider from easily loosening when the slider is assembled.

Figure 6:
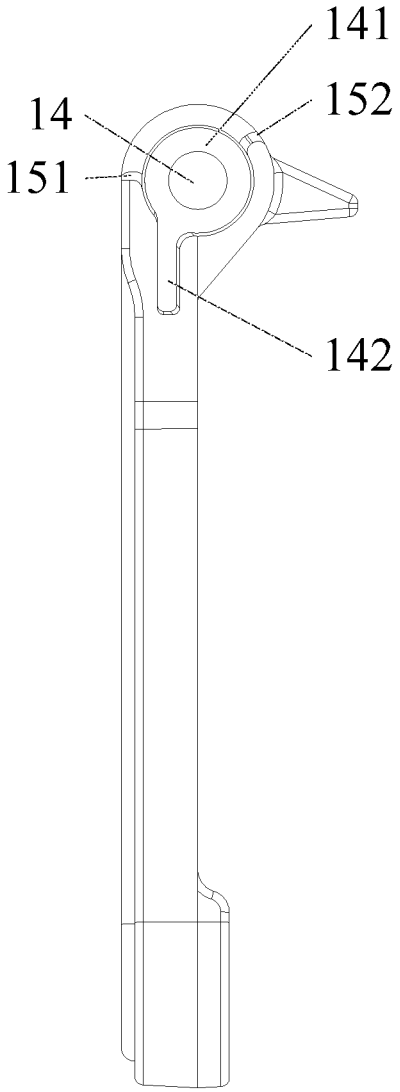
FIG. 6 is a side view of the pull-tab.
Figure 7:
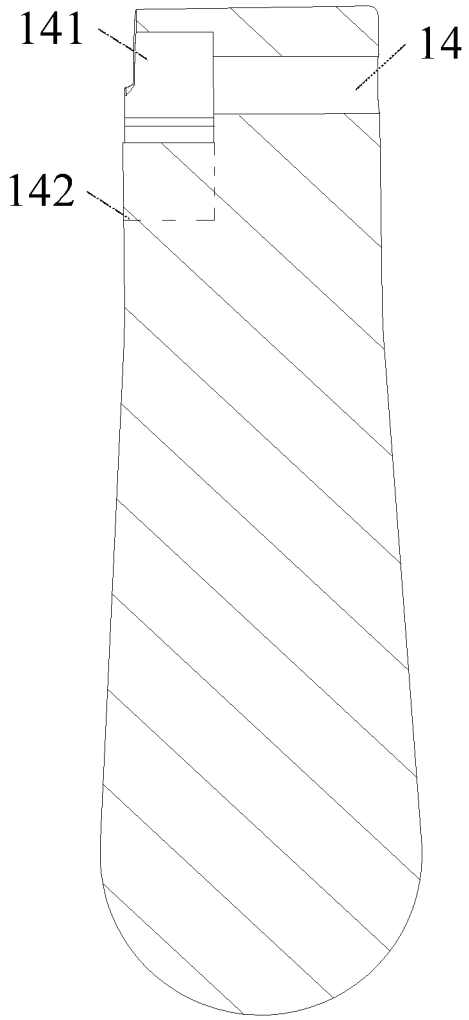
FIG. 7 is a cross-sectional view of the pull-tab from the connecting shaft through-hole.

In one embodiment of the present invention, as shown in FIG. 5 to FIG. 7, the bottom surface of the joint portion between the locking part 112 and the spring mounting part 111 has a protruding locking head 13, which inserts into the locking through-hole 251 to prevent the pull-tab 1 from sliding when the pull-tab is laid flat.

Figure 12:
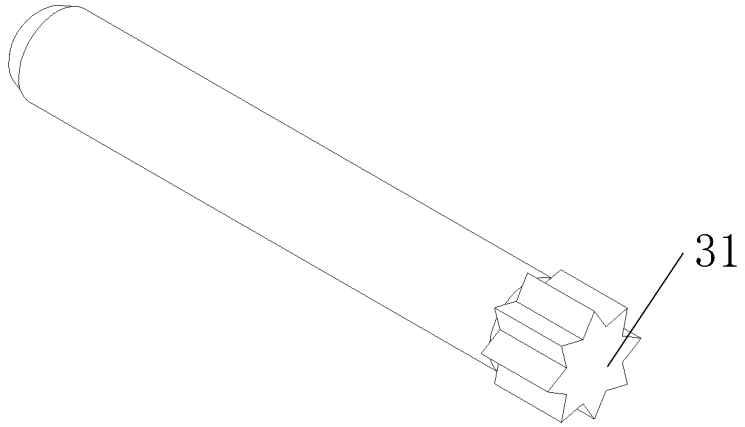
FIG. 12 is a schematic diagram of the first kind of connecting shaft.

As shown in FIG. 12, in one embodiment of the present invention, the connecting shaft 3 is set as a cylinder, one end of the cylinder has a gear-shaped fixed end 31, and its addendum circle diameter is larger than that of the first through-hole 271 and the second through-hole 272; when the slider is assembled, the fixed end 31 would be damaged and inserted into the connecting shaft through-hole 14, ensuring the fixing effect.

Figure 13:
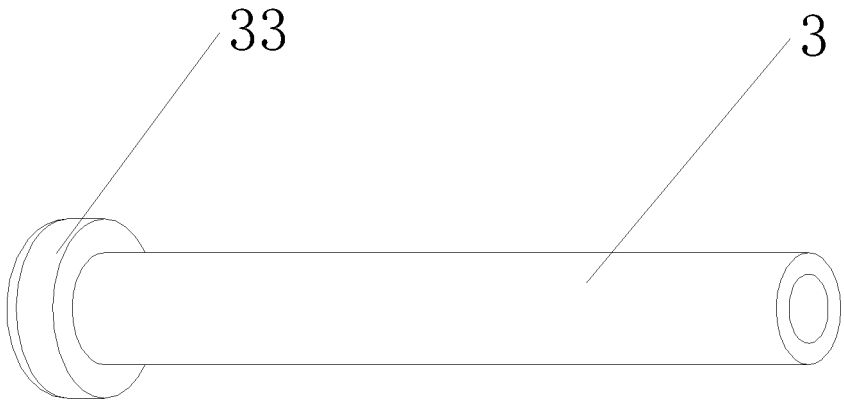
FIG. 13 is a schematic diagram of the second kind of connecting shaft.

As shown in FIG. 13, in one embodiment of the present invention, the connecting shaft 3 is set as a cylinder, whose top-end has a fixed end 33, and the bottom is set as a hollow tubular shape; when the installation is completed, the bottom is stamped and the hollow tube shape is turned outward to form a lug structure, whose external diameter is larger than the diameter of the connecting shaft through-hole 14, thus ensuring the installation effect.

As shown in FIG. 4 and FIG. 6, in one embodiment of the present invention, the spring mounting hole 141 has a sectorial sunken structure 15 set at the direction opposite to the locking head 13, and the sectorial sunken structure 15 is formed at the outer side of the spring mounting hole 141; an angle of the sectorial sunken structure 15 is larger than 90°. There are two step-terrace structures 151 and 152 formed at the joint portion between the sectorial sunken structure 15 and the spring mounting hole 141. When rotating the pull-tab 1, the sectorial sunken structure 15 enables the pull-tab 1 to keep away from the extending end of the spring 4, ensuring the normal deformation of the spring 4. And during installation, the spring 4 could be engaged onto the step-terrace structures 152 and the spring mounting hole, which facilitates assembly.

Figure 8:
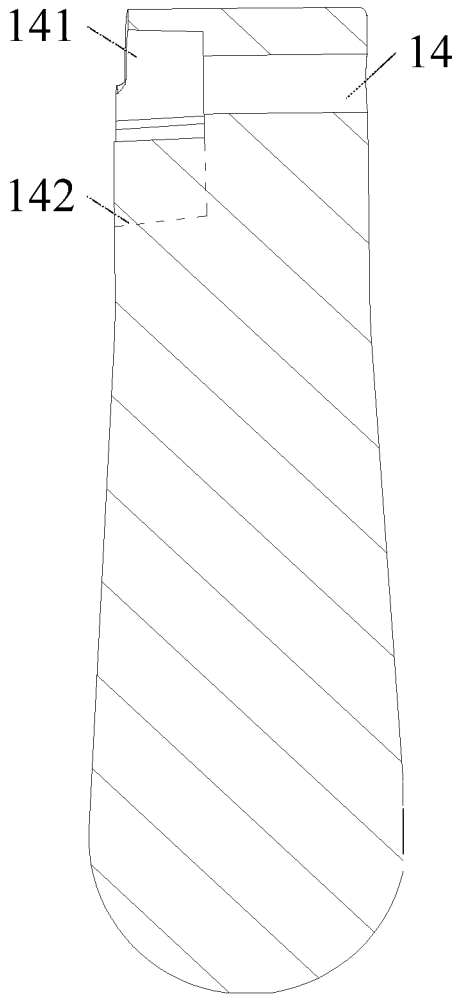
FIG. 8 is a cross-sectional view of the pull-tab from the connecting shaft through-hole in another embodiment.

As shown in FIG. 8, in one embodiment of the present invention, the spring mounting hole 141 is set as a conical platform-shape, the radius of the end with its inner side connected to the connecting shaft through-hole 14 is smaller than that of the end with its outer side connected to the pull-tab body 12. The bottom of the spring fixing hole 142 has the same design that the radius of the inner side is smaller than that of the outer side, which makes the mould release more convenient during the preparation process.

Figure 11:
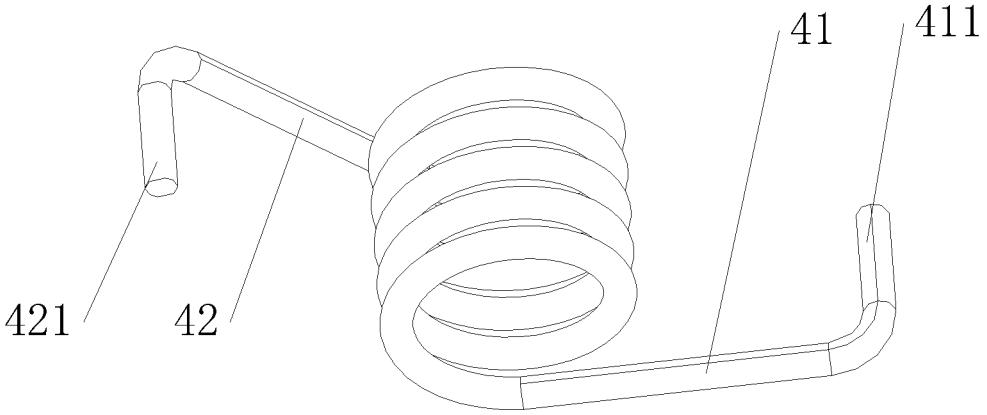
FIG. 11 is a schematic diagram of the spring in another embodiment.

As shown in FIG. 9 and FIG. 11, in one embodiment of the present invention, the second extending end 42 of the spring 4 has a fixed bending angle 421 disposed within the spring fixing hole 142; the spring fixing hole 142 connects to the spring mounting hole 141, and the spring fixing hole 142 in the pull-tab is in the same direction as the second extending end 42 of the spring, ensuring the second extending end 42 of the spring 4 inserting into the pull-tab 1 and preventing the spring 4 from falling off; the second extending end 42 of the spring 4 is tangent to the ring part of the spring 4, which would further improve the strength of the spring 4 and prolong its service life.

Figure 14:
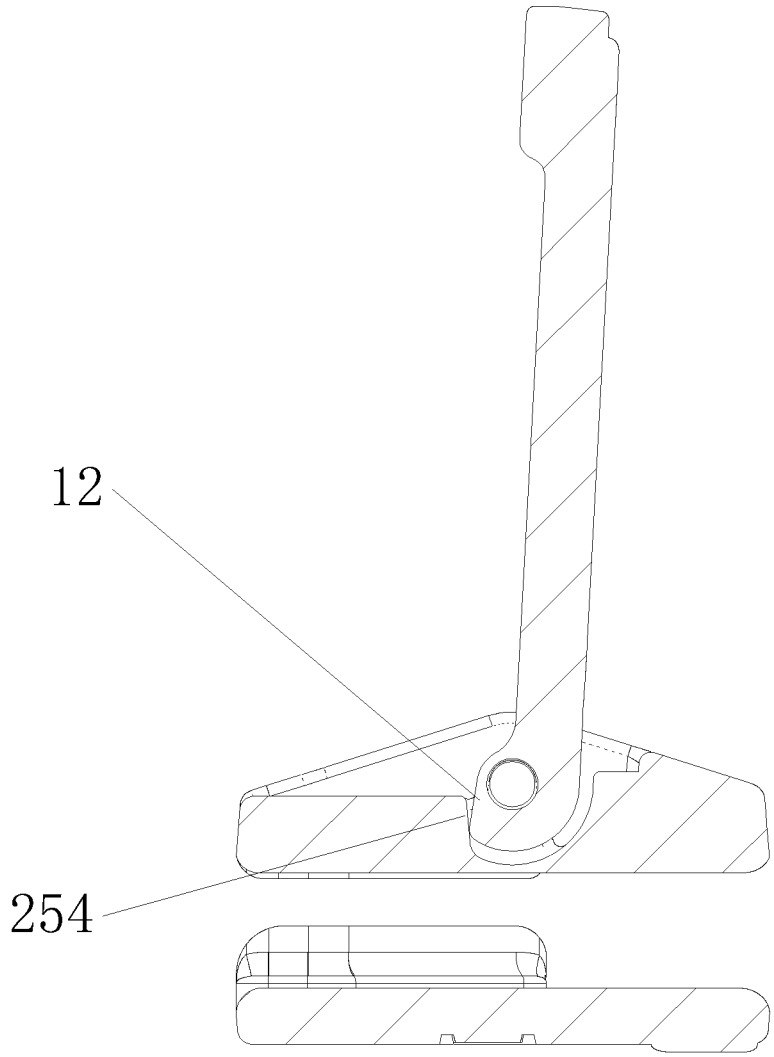
FIG. 14 is a cross-sectional view of the slider from the locking part when the pull-tab is pulled to its limits.

As shown in FIG. 14, when the pull-tab is pulled to its limits, the locking part 12 of the pull-tab 1 pushes against the locking vertical plane 254 so that the pull-tab 1 would not be allowed for further rotation.

Figure 15:
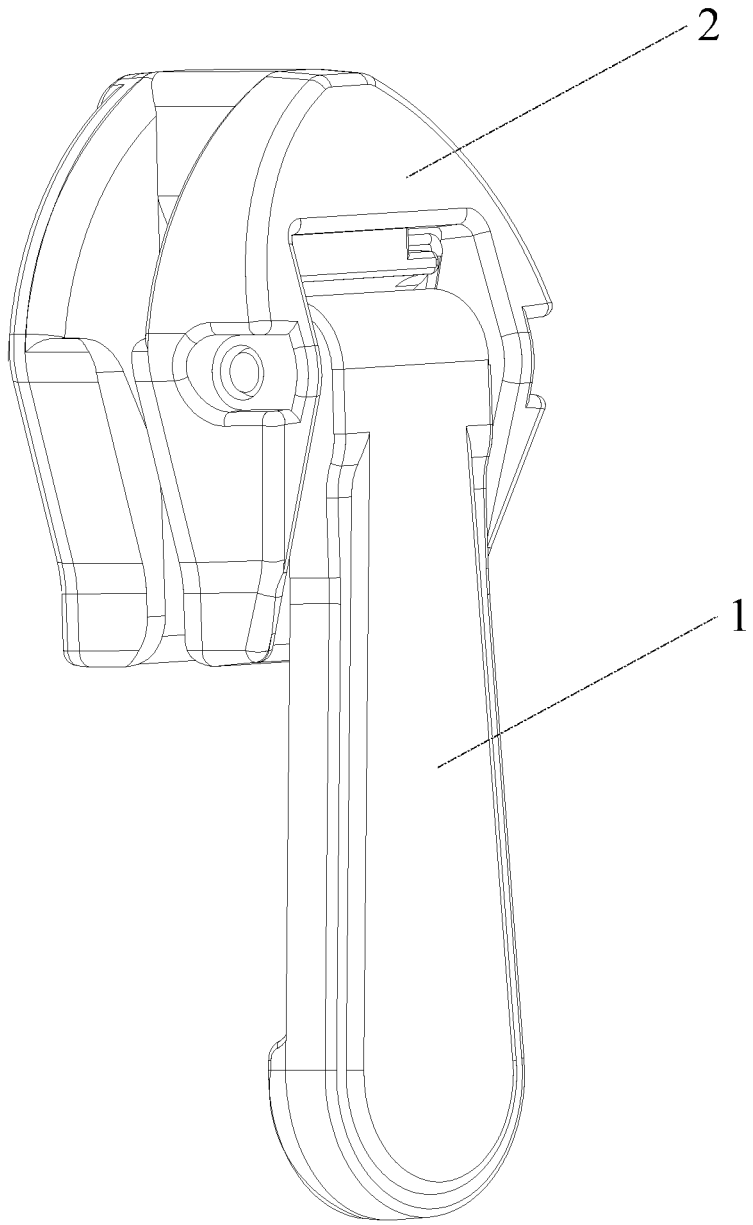
FIG. 15 is a schematic diagram of the whole slider.

As shown in FIG. 15, in one embodiment of the present invention, the connecting shaft 3 are totally hidden in the slider base, only the pull-tab 1 and slider base 2, but not the connecting shaft 3, could be seen when viewed from the front.

As shown in FIG. 6 and FIG. 10, in one embodiment of the present invention, the joint portion between the second extending end 42 of the spring 4 and the ring part of the spring 4 has a corner, and the spring fixing hole 142 in the pull-tab 1 is in the same direction as the second extending end 42 of the spring 4, ensuring the second extending end 42 of the spring 4 inserting into the pull-tab 1 and preventing the spring 4 from falling off.

As shown in FIG. 11, in one embodiment of the present invention, the first extending end 41 of the spring 4, the second extending end 42 of the spring 4 and the ring part of the spring 4 are tangent to each other, and the extending ends have corner 411 and fixed bending angle 422 respectively, and the corner 411 and fixed bending angle 422 are of the same size so that the springs are compatibly used and both extending ends could be inserted into the pull-tab body 12 and slider base 2, thus reducing the assembling difficulties.

Figure 16:
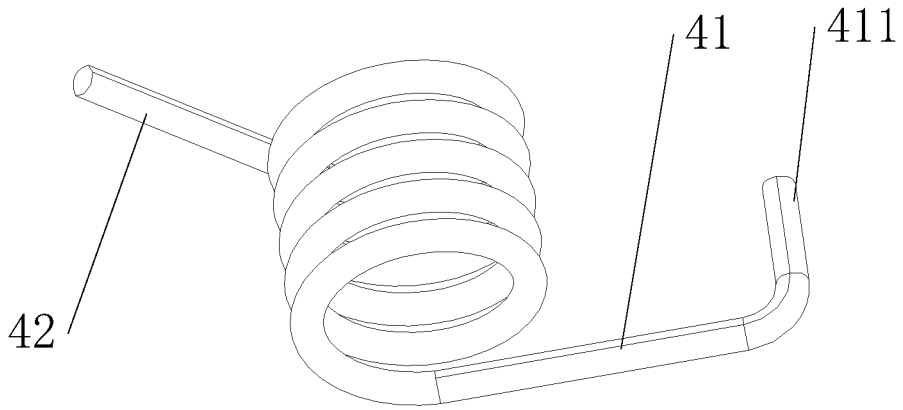
FIG. 16 is a schematic diagram of the spring in another embodiment.

As shown in FIG. 16, in one embodiment of the present invention, the second extending end 42 of the spring 4 and the ring part of the spring 4 are tangent to each other, and the second extending end 42 has no fixed bending angles, and the spring fixing hole 142 in the pull-tab 1 is in the same direction as the second extending end 42 of the spring 4, ensuring the second extending end 42 of the spring 4 inserting into the pull-tab 1 and preventing the spring 4 from falling off.

When the installation of the slider is completed, the spring is in a slightly torsionally deformed condition, pulling the pull-tab would lead to further torsional deformation of the second extending end of the spring; when the pull-tab is released, the pull-tab would recover to the normal state under the impetus of the spring.

When the pull-tab is rotated to the locking part and contacts the locking vertical plane of the slider base, it is unable to perform further rotation or movement. The limit angle of the pull-tab rotation could be adjusted by adjusting the angle of the locking vertical plane or the angle of the locking part. Due to the impetus of the spring, even the limit angle of the pull-tab rotation is very large, the failure to rebound due to over-rotation would never happen.

While the invention has been described in terms of what is presently considered to be the most practical and preferred embodiments, it is to be understood that the invention needs not be limited to the disclosed embodiment. All the terms in the present invention is used for the sake of clarity and should not constitute or be considered to be a limitation to the invention. On the contrary, it is intended to cover various modifications and similar arrangements included within the spirit and scope of the appended claims which are to be accorded with the broadest interpretation so as to encompass all such modifications and similar structures.

What is claimed is:

1. A slider with a reboundable pull-tab, comprising: A slider base, the pull-tab, a connecting shaft and a spring; the slider base comprising an upper blade, a lower blade, and a connecting pin connecting the upper blade and the lower blade; wherein, upper blade lateral sides are formed on two sides of the upper blade, each of the upper blade lateral sides has a through-hole, comprising a first through-hole and a second through-hole, for mounting the connecting shaft; the upper blade further comprises a square-shaped notch for disposing the pull-tab; the square-shaped notch comprises an arc-shaped notch, an anterior-end of the arc-shaped notch connects to sidewalls of the square-shaped notch and a posterior-end of the arc-shaped notch connects to a bottom surface of the square-shaped notch; a locking through-hole is disposed at a joint portion between the square-shaped notch and the arc-shaped notch; the locking through-hole separates the arc-shaped notch into a first arc-shaped notch on a side of the first through-hole and a second arc-shaped notch on a side of the second through-hole; an anterior-end platform is disposed at a joint portion between an anterior-end of the first arc-shaped notch and the sidewalls of the square-shaped notch, and a posterior-end of the first arc-shaped notch connects to the bottom surface by a locking vertical plane; a posterior-end of the second arc-shaped notch connects to the bottom surface directly and an anterior-end of the second arc-shaped notch connects to the sidewalls of the square-shaped notch; the anterior-end platform has a lug boss at the second arc-shaped notch;

the pull-tab comprises a pull-tab body, a top-end of the pull-tab body has a spring mounting part and a locking part, wherein the spring mounting part and the locking part are adjacent to each other; the spring mounting part has a cambered surface and the locking part has a locking cambered surface that is lower than the spring mounting part; the top-end of the pull-tab body also has a connecting shaft through-hole for assembling the connecting shaft so as to fix the pull-tab to the slider base; the spring mounting part has a spring mounting hole coaxially provided with the connecting shaft through-hole, and a radius of the spring mounting hole is larger than a radius of the connecting shaft through-hole; a lateral side of the pull-tab body has a spring fixing hole communicating with the spring mounting hole;

two ends of the spring has a first extending end and a second extending end, wherein the first extending end has a corner; when the slider is assembled, the spring is fit in the spring mounting hole;

wherein the corner is disposed at a joint portion between the lug boss and the second arc-shaped notch; the second extending end inserts into the spring fixing hole; when the slider is assembled, the spring is in a compressed state;

wherein an annular platform protruding towards the side of the second through-hole is disposed at a place where a medial side surface of the upper blade surrounds the first through-hole.

2. The slider according to claim 1, wherein two ends of the connecting shaft has fixed ends, and the through-holes have arc openings to contain the fixed ends.

3. The slider according to claim 1, a bottom surface of a joint portion between the locking part and the spring mounting part has a protruding locking head, the protruding locking head inserts into the locking through-hole when the pull-tab is laid flat.

4. The slider according to claim 3, the spring mounting hole has a sectorial sunken structure disposed at a direction opposite to the locking head, and the sectorial sunken structure is formed at an outer side of the spring mounting hole, an angle of the sectorial sunken structure is larger than 90°.

5. The slider according to claim 1, the connecting shaft is set as a cylinder, and one end of the cylinder has a gear-shaped fixed end, a diameter of an addendum circle of the gear-shaped fixed end is larger than a diameter of the first through-hole and a diameter of the second through-hole.

6. The slider according to claim 1, wherein, the second extending end of the spring has a fixed bending angle disposed within the spring fixing hole.

7. The slider according to claim 1, wherein, the spring fixing hole connects to the spring mounting hole, and an extension direction of the spring fixing hole in the pull-tab is identical to an extension direction of the second extending end of the spring.

* * * * *